US009992593B2

(12) United States Patent
Ancona et al.

(10) Patent No.: US 9,992,593 B2
(45) Date of Patent: Jun. 5, 2018

(54) ACOUSTIC CHARACTERIZATION BASED ON SENSOR PROFILING

(71) Applicant: Dell Products L.P., Round Rock, TX (US)

(72) Inventors: Rocco Ancona, Austin, TX (US); Roman J. Pacheco, Leander, TX (US); Douglas J. Peeler, Austin, TX (US); Christophe Daguet, Round Rock, TX (US); Richard W. Schuckle, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 223 days.

(21) Appl. No.: 14/480,985

(22) Filed: Sep. 9, 2014

(65) Prior Publication Data

US 2016/0073208 A1 Mar. 10, 2016

(51) Int. Cl.
*H04R 29/00* (2006.01)
*H04S 7/00* (2006.01)

(52) U.S. Cl.
CPC ..... *H04R 29/00* (2013.01); *H04S 7/301* (2013.01); *H04R 2499/11* (2013.01)

(58) Field of Classification Search
CPC ..... H04R 29/00; H04R 2499/11; H04R 3/02; H04S 7/301
USPC ..... 381/58, 59, 57, 56, 66; 348/14.01–14.16
See application file for complete search history.

(56) References Cited

U.S. PATENT DOCUMENTS

2014/0205104 A1* 7/2014 Ishikawa ..... H04S 7/302 381/58
2015/0172814 A1* 6/2015 Usher ..... H04R 3/005 381/92
2015/0281839 A1* 10/2015 Bar-On ..... G10L 21/0208 381/71.7
2016/0372139 A1* 12/2016 Cho ..... G06F 17/30

* cited by examiner

*Primary Examiner* — Vivian Chin
*Assistant Examiner* — Ammar Hamid
(74) *Attorney, Agent, or Firm* — Terrile, Cannatti, Chambers & Holland, LLP; Stephen A. Terrile

(57) ABSTRACT

A system, method, and computer-readable medium for an audio processing system which compensates for environment parameters to enhance audio inputs and outputs of an information handling system. More specifically, in certain embodiments, the audio processing system accounts for environmental characteristics including some or all of shape, size, materials, occupant, quantity, location and occlusions.

12 Claims, 3 Drawing Sheets

| Information from Camera | Camera Type Determination? | | Applicable to Which Operation? | | | |
|---|---|---|---|---|---|---|
| | Color camera | Color + Depth camera | Beam Forming | Echo Cancellation | Ambient Noise Cancellation | De-reverberation |
| Face position and distance | Limited | Yes | Yes | | Yes | |
| Face parts detection (e.g. lips) | Yes | Yes | Yes | | Yes | |
| Pet position and distance | Limited | Yes | | | Yes | |
| Motion detection (fans, cars, people, etc.) | Yes | Yes | | | Yes | |
| Object Recognition (clouds, cars, trees, fans, etc.) | Yes | Yes | Yes | | Yes | |
| Optical flow (wind and rain characterization, etc.) | Yes | Yes | | | Yes | |
| Brightness histogram (indoor/outdoor determination) | Yes | Yes | | Yes | Yes | Yes |
| Head orientation | Limited | Yes | Yes | | | |
| Surface and corner detection | Limited | Yes | | Yes | | Yes |
| Materials | Yes | Yes | | Yes | | Yes |

*Figure 3*

ACOUSTIC CHARACTERIZATION BASED ON SENSOR PROFILING

BACKGROUND OF THE INVENTION

Field of the Invention

The present invention relates to information handling systems. More specifically, embodiments of the invention relate to acoustic characterization based upon sensor profiling.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

An issue that affects information handling systems relates to sensing voice or sound input such as with an integrated microphone. With known information handling systems, voice input can be negatively impacted by the varying acoustic environment in which the information handling system is located. Some information handling systems include audio processing solutions which are often either fixed or assumption based. Additionally, known audio processing systems are often not able to determine acoustic environment details. Additionally, often known audio processing solutions are based on fixed acoustic assumptions (such as a typical user position to the information handling system) and often don't adequately compensate for a wide range of environments. Some advanced audio processing solutions perform an analysis on relative loudness of input signals to assume a preferred input signal.

SUMMARY OF THE INVENTION

A system, method, and computer-readable medium are disclosed for an audio processing system which compensates for environment parameters to enhance audio inputs and outputs of an information handling system. More specifically, in certain embodiments, the audio processing system accounts for environmental characteristics including some or all of shape, size, materials, occupant, quantity, location and occlusions.

More specifically, in certain embodiments, the invention relates to a computer-implementable method for acoustic characterization, comprising: obtaining information regarding a scene from a sensor; providing the information regarding the scene to an audio processing system; and, enhancing audio inputs and outputs based upon the information regarding the scene, the enhancing compensating for environment characteristics deduced from the information regarding the scene.

In certain other embodiments, the invention relates to a system comprising: a processor; a data bus coupled to the processor; a sensor coupled to the data bus; and a non-transitory, computer-readable storage medium storing an audio processing system embodying computer program code, the non-transitory, computer-readable storage medium being coupled to the data bus, the computer program code interacting with a plurality of computer operations and comprising instructions executable by the processor and configured for: obtaining information regarding a scene from the sensor; providing the information regarding the scene to an audio processing system; and, enhancing audio inputs and outputs based upon the information regarding the scene, the enhancing compensating for environment characteristics deduced from the information regarding the scene.

In certain other embodiments, the invention relates to a non-transitory, computer-readable storage medium embodying computer program code, the computer program code comprising computer executable instructions configured for: obtaining information regarding a scene from a sensor; providing the information regarding the scene to an audio processing system; and, enhancing audio inputs and outputs based upon the information regarding the scene, the enhancing compensating for environment characteristics deduced from the information regarding the scene.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

FIG. 3 shows a table of examples of information used by the audio processing system.

DETAILED DESCRIPTION

Figure 1:
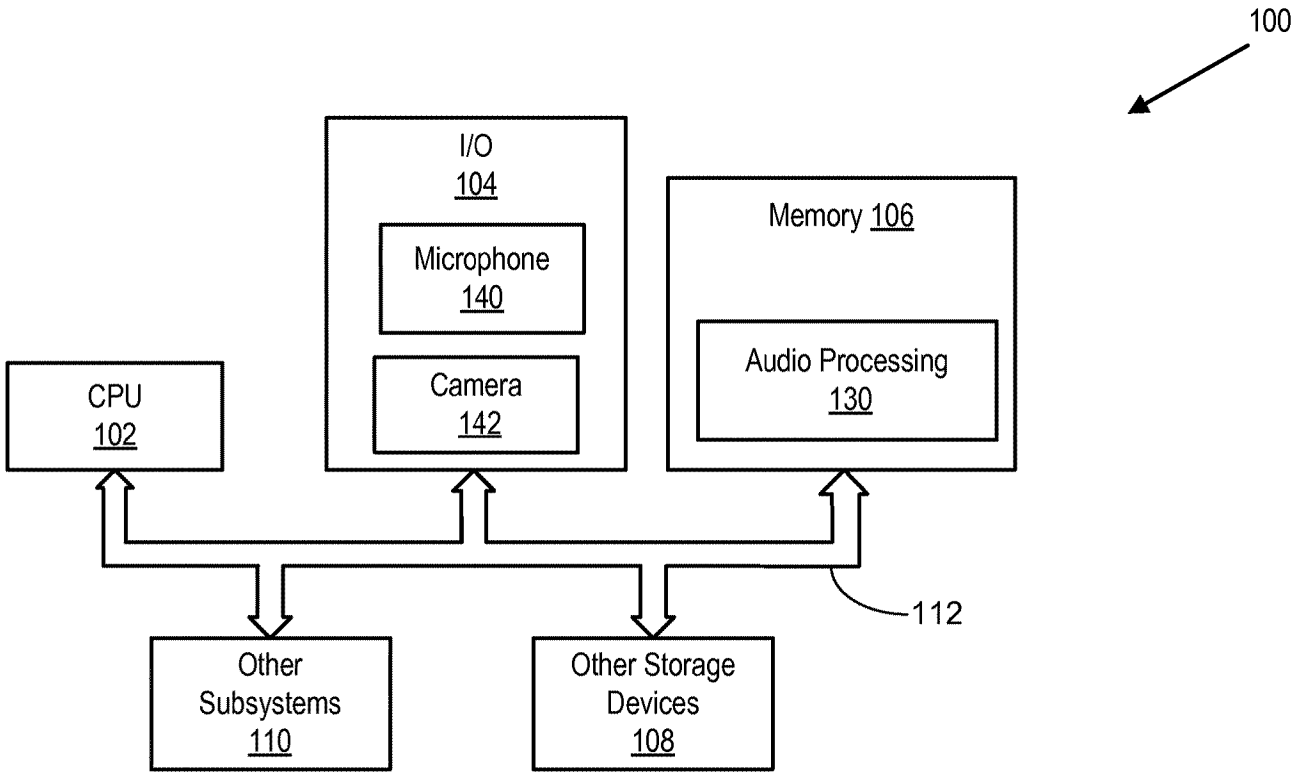
FIG. 1 shows s a general illustration of components of an information handling system as implemented in the system and method of the present invention.

FIG. 1 is a generalized illustration of an information handling system 100 that can be used to implement the system and method of the present invention. The information handling system 100 includes a processor (e.g., central processor unit or "CPU") 102, input/output (I/O) devices 104, such as a display, a keyboard, a mouse, and associated controllers, memory 106, and various other subsystems 108. The information handling system 100 likewise includes other storage devices 110. The components of the information handling system are interconnected via one or more buses 112. In certain embodiments, the I/O devices include a microphone 130 and a camera 132. It will be appreciated that the microphone 130 and camera 132 may be integrated into a single device such as a web cam type of device. The information handling system 100 further includes an audio processing system 140 stored on the memory 106 and including instructions executable by the processor 102.

The audio processing system 140 uses the camera input to characterize room and/or environment acoustics and noise sources. The audio processing system 140 then performs echo cancellation and noise suppression operations (as well as possibly other audio processing operations) to compensate for environment parameters to enhance audio inputs and outputs of an information handling system. In certain embodiments, the audio processing system further performs one or more of beam forming operations, speech input processing operations and de-reverberation operations.

The audio processing system 140 can interact with many different types of cameras 132 including front and rear facing cameras of the information handling system 100. In certain embodiments, the front facing camera provides a primary input and the rear-facing camera helps to complete the scene (i.e., provides additional information regarding the environment in which the information handling system 100 is present). The additional information regarding the environment allows the audio processing system 140 to more accurately to compensate for environment parameters to enhance audio inputs and outputs of the information handling system. Other cameras that may interact with the audio processing system 140 include complementary metal oxide semiconductor (CMOS) or charge coupled device (CCD) type cameras; multiple cameras (such as multiple CMOS or CCD type cameras) which enable a depth from disparity (or similar) operation to gather depth information; a structured or coded light camera system; and/or a Time-of-flight imager.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 2:
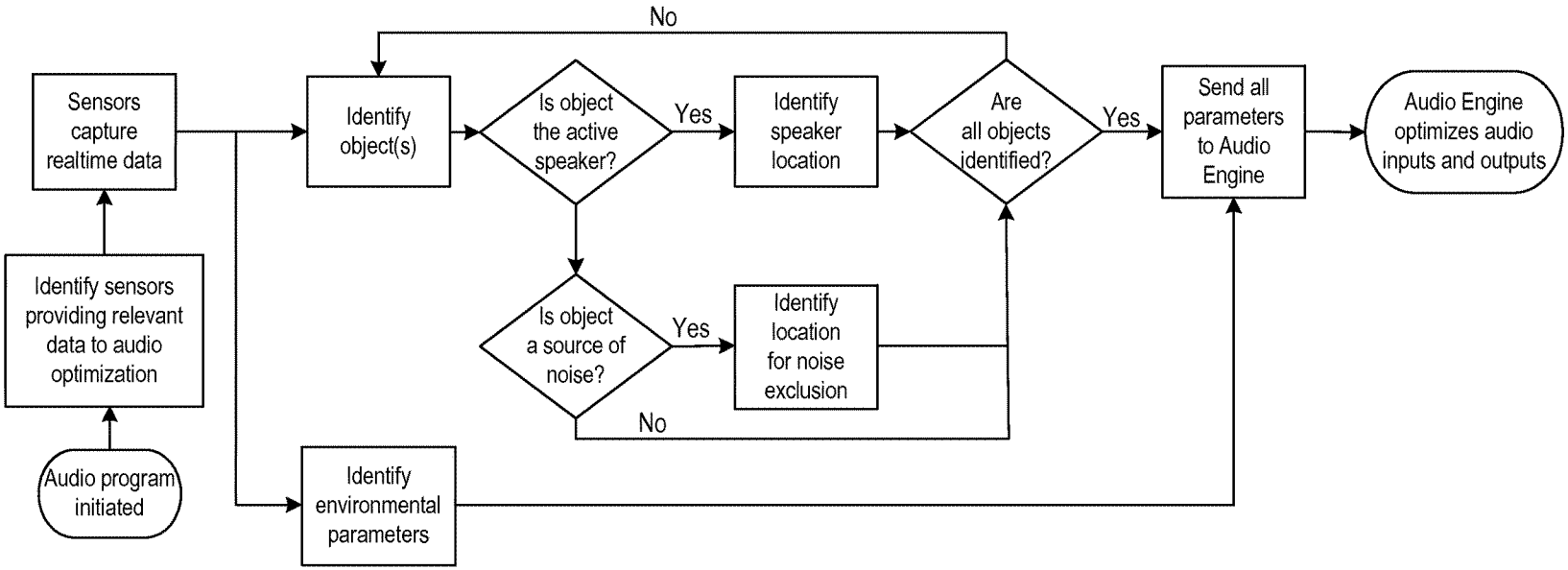
FIG. 2 shows flow chart of operation of an audio processing system.

FIG. 2 shows flow chart of operation of an audio processing system 140. More specifically, when the audio processing system 140 starts operation, the audio processing system 140 identifies sensors that will provide relevant data to perform an audio optimization at step 210. Next, at step 212, the sensors capture real time data relating to the scene in which the information handling system resides.

The real time data relating to the scene can include identification of likely ambient noise sources. Specifically, the ambient noise sources could include outdoor noise sources such as wind, traffic, water, rain, thunder, people, animals, etc. The ambient noise sources could also include indoor noise sources such as fans, people, background audio/visual type devices, etc. The sensors could perform object recognition operations, motion detection operations, flow detection operations as well as human detection operations when identifying likely ambient noise sources. The real time data can also include acoustic wave propagation and reflection data. Specifically the acoustic wave propagation and reflection data can include surface location, dimensions and/or materials. The sensors could perform three-dimensional point cloud operations, edge detection operations, object recognition operations, pattern recognition operations illumination and reflection analysis operations when identifying the acoustic wave propagation and reflection data. The real time data can also include information regarding audio targets such as a device user, whether multiple users are present, etc. The sensors could perform face detection operations, human detection operations, head orientation detection operations, face size estimation operations when identifying audio targets. The real time data can also include information relating to input audio sources such as a primary speaker out of potentially multiple users in the scene. The sensors could perform face detection operations, head orientation detection operations, face size estimation operations, and lip movement detection operations when identifying the input audio sources.

More specially, the following table provides examples of how an RGB camera type sensor and a depth camera type sensor can identify certain real time data regarding a particular scene.

| | RGB camera | Depth camera |
|---|---|---|
| Ambient noise sources | Face detection for crowd detection<br>Object recognition and optical flow for detection of indoor and outdoor objects (e.g., fans, moving trees, cars, etc.) | More accurate face detection |
| Propagation and reflection | Detection of walls vs. outdoors<br>Material detection | More accurate distance to walls and other surfaces<br>Occlusions between source and target |
| Audio targets | Face detection<br>Face distance estimation<br>Head orientation estimation | More accurate orientation and distance estimation |
| Audio sources | Face detection<br>Face distance estimation<br>Head orientation estimation | More accurate orientation and distance estimation |

Next at step 220, the audio processing system 140 identifies objects located within the scene and at step 222 identifies environmental parameters related to the scene. After identifying an object, the audio processing system 140 determines whether the object is the active speaker at step 230. If the object is the active speaker, then the audio processing system 140 identifies the location of the speaker at step 232. If the object is not the active speaker, then the audio processing system 140 determines whether the object is a source of noise at step 234. If the object is a source of noise, then the audio processing system 140 identifies the location of the object at step 236 to facilitate noise exclusion of the noise source. After steps 232 and 236, the audio processing system 140 determines whether all objects have been identified at step 240. If not, then the audio processing system 140 returns step 220 to identify another object.

If all objects have been identified then the audio processing system 140 provides the identified parameters based upon the identified objects to an audio engine portion of the audio processing system 140. Additionally, the environmental parameters identified at step 222 are sent to the audio engine portion of the audio processing system 140. Next at step 250, the audio engine optimizes the inputs and outputs based upon the identified parameters.

FIG. 3 shows a table of examples of information received by camera type and used by the audio processing system 140 when determining which type of operation to perform. The camera type can include a color camera as well as a color and color and depth sensing camera. In certain embodiments a color camera may be limited in dark lighting environments whereas a color and depth camera may include an Infrared (IR) sensing feature which can help in dark lighting environments. A depth camera also provides information about the distance of objects from the camera, which aids in object recognition, distance and orientation estimates, etc. The applicable operations can include a beam forming operation, an echo cancellation operation, an ambient noise cancellation operation and a de-reverberation operation.

More specifically, a color camera can provide limited information and a color and color and depth sensing camera can provide information to enable determination of a face position as well as a distance of the face. The audio processing system 130 uses this information to perform a beam forming operation as well as an ambient noise cancellation operation. Both a color camera and a color and depth sensing camera can provide information to enable face parts detection. The audio processing system 130 uses this information to perform a beam forming operation as well as an ambient noise cancellation operation. A color camera can provide limited information and a color and depth sensing camera can provide information to enable determination of a pet position as well as a distance of the pet. The audio processing system 130 uses this information to perform an ambient noise cancellation operation which is specific to the information relating to the pet. Both a color camera and a color and depth sensing camera can provide information which enables motion detection such as moving fans, vehicles, people in the background, etc. The audio processing system 130 uses this information to perform an ambient noise cancellation operation which is specific to the information relating to the motion. Both a color camera and a color and depth sensing camera can provide information which enables object recognition such as clouds, vehicles, trees, fans, etc. The audio processing system 130 uses this information to perform a beam forming operation and an ambient noise cancellation operation which are specific to the information relating to the objects.

Both a color camera and a color and depth sensing camera can provide information which enables identification of optical flow such as wind and rain flow characterization, etc. The audio processing system 130 uses this information to perform an ambient noise cancellation operation which is specific to the information relating to the optical flow. Both a color camera and a color and depth sensing camera can provide information which enables generation of a brightness histogram which can be used to generate location identification such as whether the device is indoors or outdoors. The audio processing system 130 uses this information to perform an echo cancellation operation, an ambient noise cancellation operation and a de-reverberation operation which are specific to the determined location.

A color camera can provide limited information and a color and depth sensing camera can provide information which enables determination of a head orientation. The audio processing system 130 uses this information to perform a beam forming operation which is specific to the orientation of the head of the user. A color camera can provide limited information and a color and depth sensing camera can provide information which enables determination of surfaces and corners of the environment in which the information handling system resides. The audio processing system 130 uses this information to perform an echo cancellation operation and a de-reverberation operation which are specific to the environment. Both a color camera and a color and depth sensing camera can provide information which enables determination of materials present in the environment in which the information handling system resides. The audio processing system 130 uses this information to perform an echo cancellation operation and a de-reverberation operation which are specific to materials present in the environment.

As will be appreciated by one skilled in the art, the present invention may be embodied as a method, system, or computer program product. Accordingly, embodiments of the invention may be implemented entirely in hardware, entirely in software (including firmware, resident software, microcode, etc.) or in an embodiment combining software and hardware. These various embodiments may all generally be referred to herein as a "circuit," "module," or "system." Furthermore, the present invention may take the form of a computer program product on a computer-usable storage medium having computer-usable program code embodied in the medium.

Any suitable computer usable or computer readable medium may be utilized. The computer-usable or computer-readable medium may be, for example, but not limited to, an electronic, magnetic, optical, electromagnetic, infrared, or semiconductor system, apparatus, or device. More specific examples (a non-exhaustive list) of the computer-readable medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, or a magnetic storage device. In the context of this document, a computer-usable or computer-readable medium may be any medium that can contain, store, communicate, or transport the program for use by or in connection with the instruction execution system, apparatus, or device.

Computer program code for carrying out operations of the present invention may be written in an object oriented programming language such as Java, Smalltalk, C++ or the like. However, the computer program code for carrying out operations of the present invention may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

Embodiments of the invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only, and are not exhaustive of the scope of the invention.

For example, sensors within the information handling system 100 other than vision type sensors may provide information to the audio processing system 140 to further enhance audio inputs and outputs of an information handling system such as by characterizes echo and ambient noise sources based upon information from the other sensors. For example, a motion sensor could provide information regarding vibrations occurring within the environment in which the information handling system resides. Also for example, temperature and/or altitude sensors could provide information which would enable the audio processing system 140 to accommodate sound propagation characteristics. Also for example, a wireless Personal Area Network (PAN) type sensor (such as a Bluetooth type low energy (LE) sensor) could be used to detect user presence by determining when a short range device such as a Bluetooth device is present.

Consequently, the invention is intended to be limited only by the spirit and scope of the appended claims, giving full cognizance to equivalents in all respects.

What is claimed is:

1. A computer-implementable method for acoustic characterization, comprising:

obtaining information regarding a scene from a sensor, the information regarding the scene comprising visual information regarding the scene;

providing the information regarding the scene to an audio processing system; and, enhancing audio inputs and outputs based upon the information regarding the scene, the enhancing compensating for environment characteristics deduced from the visual information regarding the scene; and wherein the sensor comprises a camera; and, the camera comprises front and rear facing cameras, the front facing camera provides a primary input, the primary input providing the information regarding the scene via front facing camera visual information and the rear-facing camera providing additional information to complete the scene, the additional information to complete the scene comprising rear-facing camera visual information, the audio processing system using the front facing camera visual information and rear-facing camera visual information to identify objects located within the scene and the to identify environmental parameters related to the scene, the environmental parameters comprising location parameters, the audio processing system using the front facing camera visual information and the rear-facing camera visual information to characterize room and environment acoustics and noise sources, the audio processing system performing echo cancellation and noise suppression operations to compensate for the identified objects and environmental parameters.

2. The method of claim 1, wherein:

the environmental characteristics comprise at least one of shape, size, materials, occupant, quantity, location and occlusions.

3. The method of claim 1, wherein:

the audio processing system performs at least one of beam forming operations, speech input processing operations and de-reverberation operations based upon the information regarding the scene.

4. A system comprising:

a processor;

a data bus coupled to the processor;

a sensor coupled to the data bus; and a non-transitory, computer-readable storage medium storing an audio processing system embodying computer program code, the non-transitory, computer-readable storage medium being coupled to the data bus, the computer program code interacting with a plurality of computer operations and comprising instructions executable by the processor and configured for: obtaining information regarding a scene from a sensor, the information regarding the scene comprising visual information regarding the scene;

providing the information regarding the scene to an audio processing system; and, enhancing audio inputs and outputs based upon the information regarding the scene, the enhancing compensating for environment characteristics deduced from the visual information regarding the scene; and wherein the sensor comprises a camera; and, the camera comprises front and rear facing cameras, the front facing camera provides a primary input, the primary input providing the information regarding the scene via front facing camera visual information and the rear-facing camera providing additional information to complete the scene, the additional information to complete the scene comprising rear-facing camera visual information, the audio processing system using the front facing camera visual information and rear-facing camera visual information to identify objects located within the scene and the to identify environmental parameters related to the scene, the environmental parameters comprising location parameters, the audio processing system using the front facing camera visual information and the rear-facing camera visual information to characterize room and environment acoustics and noise sources, the audio processing system performing echo cancellation and noise suppression operations to compensate for the identified objects and environmental parameters.

5. The system of claim 4, wherein:

the environmental characteristics comprise at least one of shape, size, materials, occupant, quantity, location and occlusions.

6. The system of claim 4, wherein:

the audio processing system performs at least one of beam forming operations, speech input processing operations and de-reverberation operations based upon the information regarding the scene.

7. A non-transitory, computer-readable storage medium embodying computer program code, the computer program code comprising computer executable instructions configured for:

obtaining information regarding a scene from a sensor, the information regarding the scene comprising visual information regarding the scene;

providing the information regarding the scene to an audio processing system; and, enhancing audio inputs and outputs based upon the information regarding the scene, the enhancing compensating for environment characteristics deduced from the visual information regarding the scene; and wherein the sensor comprises a camera; and, the camera comprises front and rear facing cameras, the front facing camera provides a primary input, the primary input providing the information regarding the scene via front facing camera visual information and the rear-facing camera providing additional information to complete the scene, the additional information to complete the scene comprising rear-facing camera visual information, the audio processing system using the front facing camera visual information and rear-facing camera visual information to identify objects located within the scene and the to identify environmental parameters related to the scene, the environmental parameters comprising location parameters, the audio processing system using the front facing camera visual information and the rear-facing camera visual information to characterize room and environment acoustics and noise sources, the audio processing system performing echo cancellation and noise suppression operations to compensate for the identified objects and environmental parameters.

8. The non-transitory, computer-readable storage medium of claim 7, wherein:

the environmental characteristics comprise at least one of shape, size, materials, occupant, quantity, location and occlusions.

9. The non-transitory, computer-readable storage medium of claim 7, wherein:

the audio processing system performs at least one of beam forming operations, speech input processing operations and de-reverberation operations based upon the information regarding the scene.

10. The method of claim 1, wherein:

when generating the front facing camera visual information and rear-facing camera visual information, the sensor performs object recognition operations, motion detection operations, flow detection operations and human detection operations.

11. The system of claim 4, wherein:

when generating the front facing camera visual information and rear-facing camera visual information, the sensor performs object recognition operations, motion detection operations, flow detection operations and human detection operations.

12. The non-transitory, computer-readable storage medium of claim 7, wherein:

when generating the front facing camera visual information and rear-facing camera visual information, the sensor performs object recognition operations, motion detection operations, flow detection operations and human detection operations.

* * * * *